United States Patent [19]

Miller et al.

[11] Patent Number: 4,667,486

[45] Date of Patent: May 26, 1987

[54] REFRIGERATED PENETRATION INSERT FOR CRYOSTAT WITH AXIAL THERMAL DISCONNECT

[75] Inventors: Russell S. Miller; Steven J. Brzozowski, both of Scotia, N.Y.

[73] Assignee: General Electric Company, Schenectady, N.Y.

[21] Appl. No.: 859,582

[22] Filed: May 5, 1986

[51] Int. Cl.[4] ..... F25B 19/00

[52] U.S. Cl. ..... 62/514 R; 62/45; 62/298; 285/47; 285/904

[58] Field of Search ..... 62/45, 514 R, 298; 285/47, DIG. 5

[56] References Cited

U.S. PATENT DOCUMENTS

| | | | |
|---|---|---|---|
| 3,066,222 | 11/1962 | Poorman et al. | 62/514 R |
| 3,309,884 | 3/1967 | Pauliukonis | 62/45 |
| 3,377,813 | 4/1968 | Mordhorst | 62/45 |
| 3,399,691 | 9/1968 | Schoch et al. | 62/55 |
| 3,483,709 | 12/1969 | Baicker et al. | 62/514 R |
| 3,714,942 | 2/1973 | Fischel et al. | 62/45 |
| 3,894,403 | 7/1975 | Longsworth | 62/55 |
| 4,279,127 | 7/1981 | Longsworth | 62/514 R |
| 4,384,222 | 5/1983 | Zerlik | 62/505 |
| 4,516,404 | 5/1985 | Laskaris | 62/514 R |
| 4,522,034 | 6/1985 | Laskaris | 62/514 R |
| 4,526,015 | 7/1985 | Laskaris | 62/514 R |
| 4,535,596 | 8/1985 | Laskaris | 62/514 R |
| 4,562,703 | 1/1986 | Miller et al. | 62/514 R |

*Primary Examiner*—Ronald C. Capossela

*Attorney, Agent, or Firm*—William H. Steinberg; James C. Davis, Jr.; Paul R. Webb, II

[57] ABSTRACT

An axial disconnect is provided for use with refrigerator systems in which the valve motor and displacer drive are not on the same axis as the displacer (cold end) or for situations where the stresses transmitted to the plug shields are to be minimized. The axial refrigeration connection allows field interruption of the refrigerator-cryostat conduction path to prevent excessive heat leak to the cryostat in the event of a refrigerator failure or scheduled service.

6 Claims, 4 Drawing Figures

21
23
23a
25
25a
31
33
39
41
43
45
47
51
53
55
57
11b
11e

REFRIGERATED PENETRATION INSERT FOR CRYOSTAT WITH AXIAL THERMAL DISCONNECT

CROSS REFERENCE TO RELATED APPLICATIONS

The present invention is related to copending applications Ser. No. 826,058 filed Feb. 2, 1986 entitled "A Horizontal Cryostat Penetration With a Vertical Service Stack" and application Ser. No. 859,583 filed May 5, 1986 entitled "Refrigerated Penetration Insert For Cryostat With Rotating Thermal Disconnect" both assigned to the instant assignee and both hereby incorporated by reference.

BACKGROUND OF THE INVENTION

The present invention relates to cryostat penetration plugs having a field interruptible cryogenic refrigerator interface.

In the generation of medical diagnostic images in magnetic resonance (MR) imaging, it is necessary to provide a temporally stable and spatially homogeneous magnetic field. The use of superconductive electrical materials maintained at a temperature below their critical transition temperatures, provides an advantageous means to produce such a field. Accordingly, for such MR imaging devices, a cryostat is employed. A cryostat contains an innermost chamber in which liquid helium, for example, is used to cool the superconductor materials. The cryostat itself, typically comprises a generally toroidal structure with other nested toroidal structures inside the exterior vessel, to provide the desired vacuum conditions and thermal shielding. Since it is necessary to provide electrical energy to the main magnet coil and to various collection coils employed in MR imaging and to replenish coolant material it is necessary that there be at least one penetration through the cryostat walls.

During magnet operation, superconductive temperatures are maintained by helium evaporation as well as by nitrogen evaporation from a nitrogen vessel surrounding and shielding the inner helium vessel. To reduce the expense of replacing cryogenic fluids, a cryogenic refrigerator can be coupled to the cryostat to remove heat from the cryostat radiation shields and thereby reduce cryogen fluid evaporation. Refrigeration can lower the temperature of the intermediate radiation shield surrounding the helium vessel. Radiation heating between the intermediate shield and the helium vessel varies as the fourth power of the shield temperature so reducing the shield temperature by one half would result in a sixteen fold reduction in heat radiation transfer.

Several methods of interfacing cryogenic refrigerators to cryostats have been proposed. Most of these address the need for good thermal contact while maintaining a reasonable ability to remove and/or service the refrigerator. U.S. Pat. No. 4,279,127 describes a refrigerator using a vertical orientation which allows helium gas stratification if the refrigerator fails or is removed for service. The current invention is directed towards an application requiring a substantially horizontal orientation which prohibits the use of a gas space which would develop convection cells.

The rotating disconnect described in application Ser. No. 859,583 filed on May 5, 1986 and assigned to the instant assignee solves the problem of providing a simple field disconnect and is entirely compatible with some types of refrigeration systems. The refrigeration systems for which the rotating system would work well are those in which the cold head components (valve and motor) are on the same axis as the displacer. Unfortunately, many systems are configured with the drive system perpendicular to the displacer and these refrigeration systems could offer potential advantages with regard to reliability and vibration and isolation from high magnetic field regions. Rotating a cold end refrigeration system with the drive system perpendicular to the displacer, about the axis of the displacer will be difficult due to the large displacements that would occur at the motor.

It is an object of the present invention to provide an interface for a horizontal cryostat penetration insert for a magnetic resonance magnet, coupling a 1, 2 or 3 stage cryogenic refrigerator to the penetration insert.

It is a further object of the present invention to provide an interface with an axial moving disconnect between a cryogenic refrigerator and a cryostat penetration insert that minimizes stress on the cryostat penetration insert radiation shields.

It is still a further object of the present invention to provide an interface that provides an easily activated, field thermal disconnect in the event of a refrigerator failure.

It is another object of the present invention to provide an interface which can accommodate refrigerator cold ends with off-axis drives for the valve and displacer.

SUMMARY OF THE INVENTION

In one aspect of the present invention an interface for a horizontal cryostat penetration for coupling a cryogenic refrigerator cold end to the cryostat penetration insert is provided. The insert has an outer housing and a thermal radiation shield. The cryogenic refrigerator cold end has a stage. The insert comprises an extension of the outer housing which provides access to the interior of the housing. An extension of the thermal radiation shield extends into the housing extension. The extension of the thermal radiation shield has a flexible portion compressible in the axial direction. A first thermal contact means is affixed to the end of the thermal radiation shield extension. The first thermal contact means defines a central aperture and provides heat conduction from the shield extension to the first thermal contact means. A second thermal contact means is affixed to the stage of the cryogenic refrigerator cold end to provide heat conduction from the second thermal contact means to the cryogenic refrigerator stage. Engagement stop means are secured to the outer housing and positioned to come in contact with the first thermal contact means when the cold end is axially inserted. The engagement stop means limit the axial compression of the flexible portion of the extension of the thermal radiation shield and prevent excessive axial forces from being transmitted to the insert shield.

BRIEF DESCRIPTION OF THE DRAWING

While the specification concludes with claims particularly pointing out and distinctly claiming the present invention, objects and advantages of the invention can be more readily ascertained from the following description of a preferred embodiment when used in conjunction with the accompanying drawing in which:

DETAILED DESCRIPTION OF THE DRAWING

Figure 1:
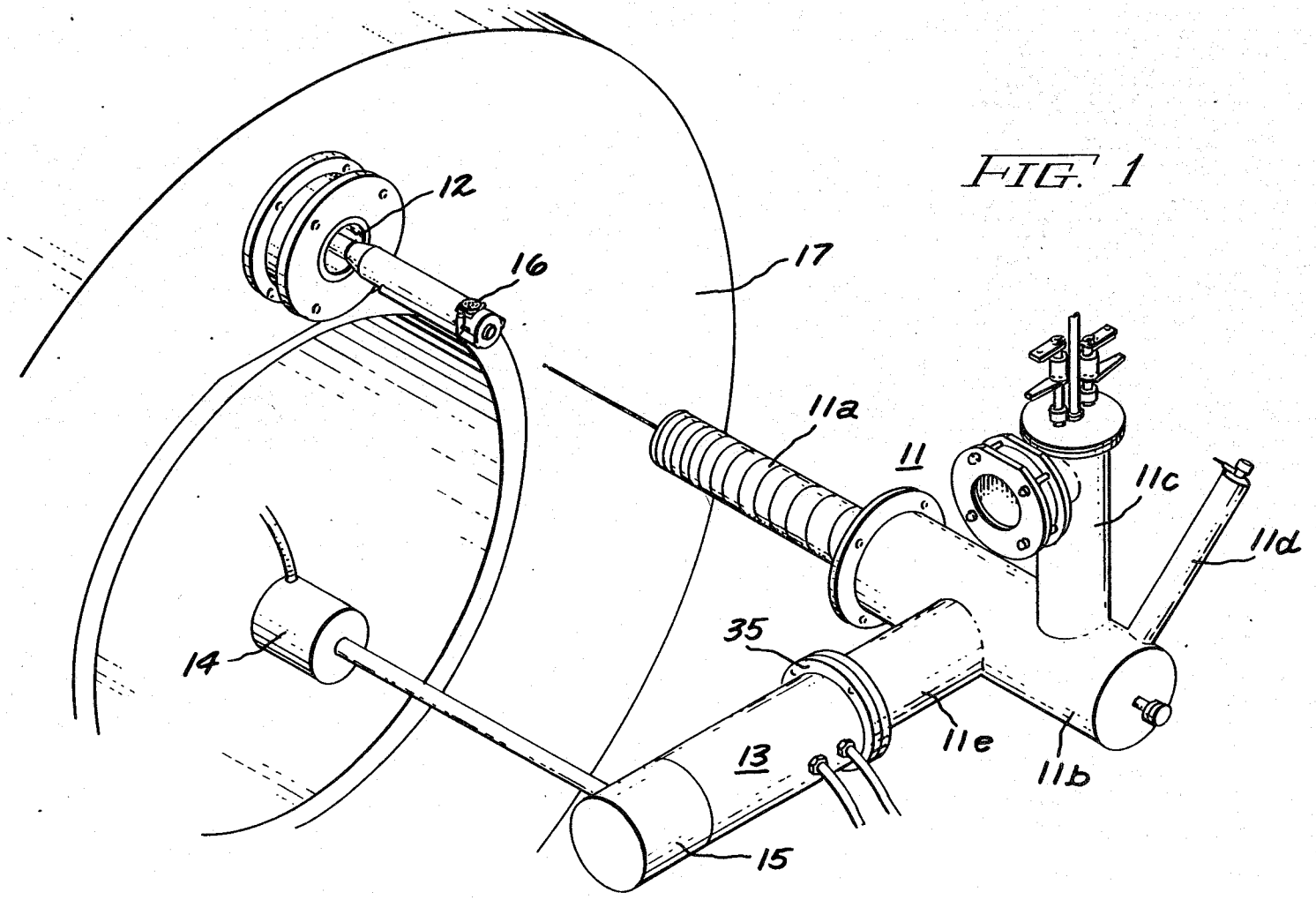
FIG. 1 is an exploded isometric view of a cryostat and a cryostat insert penetration with a cryogenic refrigerator and cryogenic refrigerator interface, in accordance with the present invention.

Referring now to the drawing wherein like reference numerals indicate like elements throughout and more particularly to FIG. 1 thereof. A vacuum jacketed insert 11 of the type described and claimed in application Ser. No. 826,058 filed Feb. 2, 1986 entitled "A Horizontal Cryostat Penetration With a Vertical Service Stack" is shown, modified to accept a cryostat refrigerator cold end 13 having a valve motor 14 extending perpendicular to the displacer portion 15.

The insert 11 has a first horizontal portion 11*a* which extends into a cryostat penetration 12 and a second horizontal portion 11*b* having an ambient temperature shell. A vertical service stack 11*c* extends vertically from the second horizontal portion providing access to electrical leads 16 extending from a cryostat penetration 12 in cryostat 17. A slant fill tube 11*d* extends from the second horizontal portion and is used for adding liquid helium to the cryostat. An interface 11*e* for connecting a two stage cryogenic refrigerator cold end to the cryostat is also shown extending from the second horizontal portion 11*b*.

Figures 2, 3, 4:
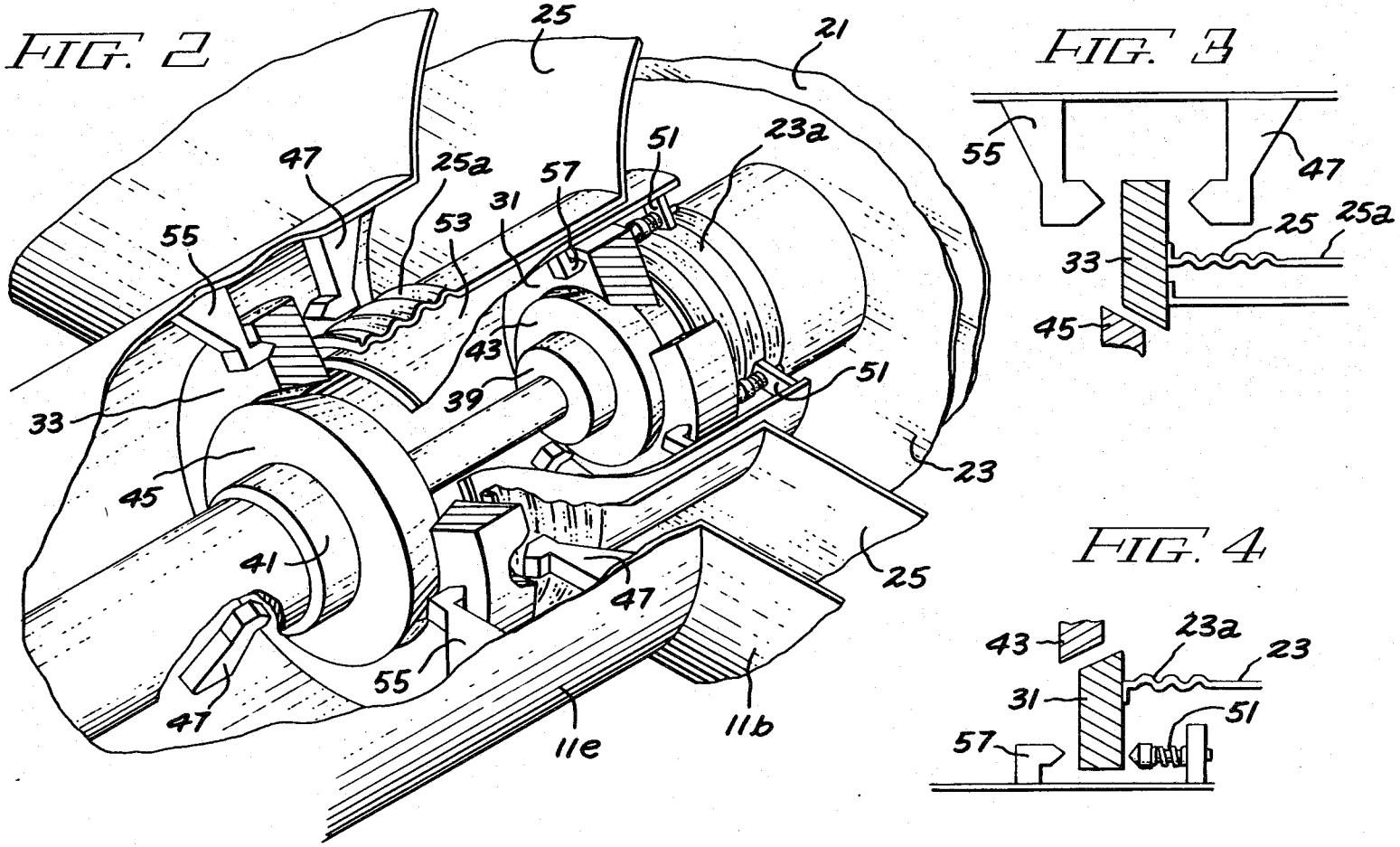
FIG. 2 is a partially cutaway isometric view of a portion of the horizontal cryostat insert together with the interface, in accordance with the present invention.
FIG. 3 is a cut away side view of an engagement and a disengagement stop of the interface associated with the first stage coupling.
FIG. 4 is a cut away side view of the spring loaded engagement stop and disengagement stop associated with the second stage coupling.

Referring now to FIG. 2, the insert 11 has an inner 4.2° K. envelope 21 which is in flow communication with the interior of the helium vessel, located in the cryostat 17, when the first horizontal portion 11*a* of the insert is situated in the cryostat penetration 12. Inner and outer radiation shields 23 and 25, respectively, are situated in the insert 11. The inner radiation shield 23 surrounds the 4.2° K. envelope 21 and the outer radiation shield 25 surrounds the inner radiation shield 23. When the insert is situated in the cryostat 17 and a superconducting magnet situated in the cryostat is operating in the persistent mode, the inner and outer shields are heat stationed to an intermediate and an outer radiation shield (both not shown) located in the cryostat 17.

The interface 11*e* comprises a generally cylindrical extension of the ambient temperature shell, which can be fabricated of nonmagnetic material such as stainless steel and extends perpendicularly from the second horizontal portion 11*b* of the insert. The inner and outer shields 23 and 25, respectively, extend from the second horizontal portion 11*b* of the insert as concentric cylinders with each of the concentric cylinders terminating in a coupling 31 and 33, respectively. The inner and outer shields are fabricated from non-magnetic heat conductive material such as copper. The inner shield 23, which is also the inner concentric cylinder, is the colder of the two shields during magnet operation. Although the inner shield extends to form a cylinder, the inner shield continues to surround the 4.2° K. envelope at the base of the extending cylinder. The inner concentric cylinder 23 extends through an opening in the outer shield 25. The outer concentric cylinder 25 extends from the perimeter of the opening through which the inner concentric cylinder extends. The inner concentric cylinder extends part way into the ambient temperature shell of the interface and terminates in coupling 31. The outer concentric cylinder extends further into the interface and terminates in coupling 33. The inner and outer concentric cylinders 23 and 25 have a flexible portion adjacent to the couplings formed in the present embodiment by circumferential convolutions forming a bellows portion 23*a* and 25*a*, respectively.

The couplings 31 and 33 each comprise rings of heat conductive material such as copper. The rings are secured to the concentric cylinders such as by soldering. The inside diameters of the rings have a tapered aperture with the wider aperture facing away from second horizontal portion insert 11*b* and towards the refrigerator. The ambient temperature shell of the interface terminates in a flange 35 shown in FIG. 1. A two stage closed cycle refrigerator, commercially available from manufacturers such as Air Products, Allentown, PA and CTI, Waltham, MA, comprises a compressor (not shown) for providing pressurized helium gas and a cold end. The cold end 13 comprises a valve motor 14 and two expander engines located in cylindrical housing terminating in a first and second stage having copper ring heat stations 39 and 41. Truncated cone shaped couplings 43 and 45 of heat conductive material such as copper having a central aperture are each soldered to the ends of the heat stations 39 and 41, respectively. The narrow portions of the truncated cones are situated towards the end portion of the cold end to be inserted in the interface. The couplings 31 and 33 at the end of the cylindrical extensions of the shields are longitudinally spaced apart the same distance as the truncated cone shaped couplings 43 and 45. The couplings 43 and 45 fit inside the couplings 31 and 33, respectively, with the truncated cones of couplings 43 and 45 mating with the tapered apertures located in couplings 31 and 33.

Metal to metal thermal contact improves with increasing normal forces, however, if these forces are achieved with direct axial insertion of the refrigerator cold end, significant torque would be exerted about the insert shield termination points. These torques could deform the thin shield wall or result in direct contact between the shields producing thermal shorts. Neither of these events is acceptable. It is therefore necessary for the contact forces to be absorbed elsewhere. Three equally circumferentially spaced rigid stops 47 are situated in the interior of the ambient temperature shell extension, attached to the interior wall of the ambient temperature shell and extending radially inwardly. The stops transmit axial insertion forces from coupling 45 to coupling 33, directly to the ambient temperature shield extension. The stops are engaged by movement of the coupling 33 toward the longitudinal axis of the second horizontal portion 11*b* only during active refrigeration. The contact travel upon engagement is taken up by the flexible connection 25*a* situated on shield 25. The stops minimize the forces transmitted to the outer shield in the insert, but allows thermal contact between the couplings and axial alignment. The stops can be fabricated of stainless steel with a knife edge contact to minimize heat transfer when the couplings and the stop come in contact.

When the contacts used are sliding metal to metal contacts, such as shown in U.S. Pat. No. 4,562,703 entitled "Plug Tube For NMR Magnet Cryostat", failure to engage 100% of the contacts would not be a significant problem, permitting tolerances on the axial spacing of the contacts, associated with the inner and outer shields, to be many tens of mils and still only represent a loss of only 5% in heat transfer contact area. However, since mating cones are being used in the present embodiment, simultaneous engagement of all coupling contact points, are required. Spring loaded travel of engagement stops 51 associated with coupling 31 permit simultaneous engagement of coupling 31 and 43, and 33 and 45. The three spring loaded stops 51 are equally spaced about a low heat conductivity cylinder 53 attached to coupling 33 and surrounding the second stage of the regenerator on the refrigerator to minimize radiation to the colder shield in the event of a refrigerator failure. Also shown are rigid disengagement stops 55 mounted on the interior of the ambient temperature shield extension and rigid disengagement stops 57 mounted on the low conductivity cylinder to prevent excessive axial forces from being transmitted to the insert shields if sticking of the mating cones should occur during disengagement.

In operation the compressor (not shown) supplies helium gas under pressure to the cold end 13 which cools the first and second stage heat exchangers to approximately 20° K. and 40° K., respectively. The continuation of the inner radiation shield 23 across the base of the cylindrical extension of the shield, assures that the inner 4.2° K. envelope 21 will not be directly exposed to radiation from the end of the first stage when the refrigerator is not operating. Radiation shield 53 coupled to contact 33 surrounds the second stage of the refrigerator to minimize radiation to the inner shield 23 when the refrigerator is not operating.

The most probable type of failure of two or three stage cryogenic refrigerators involves compressor stoppage due to a loss of compressor cooling, motor failure, or power outage. By axially retracting the refrigerator cold end a short distance the contacts will be open on the vacuum that exists in the insert will not have to be broken to service the refrigerator.

Since two or three thermal couplings may be needed on the same axial center line depending on how many stages the refrigerator has, and since it is desirable that good engagement of all contacts is made simultaneously, one of the contact surfaces can be covered with a crushable metal felt or soft metal such as indium.

The foregoing describes an interface, with an axial moving disconnect for a horizontal cryostat penetration insert of a magnetic resonance magnet for coupling a 1, 2 or 3 stage cryogenic refrigerator to the penetration insert.

While the invention has been particularly shown and described with reference to a preferred embodiment thereof, it will be understood by those skilled in the art that various changes in form and detail may be made without departing from the spirit and scope of the invention.

What is claimed is:

1. An interface for a horizontal cryostat penetration insert for coupling a cryogenic refrigerator cold end to the cryostat penetration insert, said insert having an outer housing and a thermal radiation shield, said cryogenic refrigerator cold end having at least one stage, said interface comprising:

an extension of said outer housing providing access to the interior of said housing;

an extension of said thermal radiation shield into said housing extension, said shield having a flexible portion compressible in the axial direction;

a first thermal contact means affixed to the end of said thermal radiation shield extension, said first thermal contact means defining a central aperture and providing heat conduction from said shield extension to said first thermal contact means;

a second thermal contact means affixed to said stage of the cryogenic refrigerator cold end to provide heat conduction from the second thermal contact means to the cryogenic refrigerator stage; and engagement stop means secured to said outer housing, said stop means positioned to come in contact with said first thermal contact means when said cold end is axially inserted, limiting the compression of said flexible portion of the extension of said thermal radiation shield, thereby preventing excessive axial forces from being transmitted to the insert shield.

2. The apparatus of claim 1 wherein said first thermal contact means comprises a ring with a tapered central aperture and said second thermal contact comprises a truncated cone shaped mating portion, adapted to fit in the central aperture of the first thermal contact means.

3. An interface for a horizontal cryostat penetration insert for coupling a cryogenic refrigerator cold end to the cryostat penetration insert, said insert having an outer housing and a first and second thermal radiation shields, said cryogenic refrigerator cold end having two stages, said interface comprising:

a cylindrical extension of said outer housing providing access to the interior of said housing;

a cylindrical extension of said first radiation shield into said housing extension, said extension having a flexible portion compressible in the axial direction;

a cylindrical extension of said second thermal radiation shield into said housing, the extension of said second thermal radiation shield situated in the extension of said first thermal radiation shield, said extension of said second thermal radiation shield having a flexible portion which compresses in the axial direction;

a first thermal contact means affixed to the end of the extension of said first thermal radiation shield extension, said first thermal contact means defining a central aperture and providing heat conduction from the extension of said first shield to said first thermal contact;

a second thermal contact affixed to said first stage of the cryogenic cold end to provide heat conduction from the second thermal contact means to the first stage of the cryogenic refrigerator;

a third thermal contact means affixed to the end of the extension of said second thermal radiation shield extension, said second thermal contact means defining a central aperture and providing heat conduction from the extension of said second shield to said first thermal contact;

a fourth thermal contact means affixed to said second stage of the cryogenic cold end to provide heat conduction from the third thermal contact means to the second stage of the cryogenic refrigerator;

a cylindrical third radiation shield coupled to said first thermal contact means and surrounding said thermal contact means, said third radiation shield situated inside said first radiation shield;

first engagement stop means secured to the interior of the outer housing, said means adapted to come in contact with said first thermal contact means when said cold end is axially inserted, limiting the compression of the flexible portion of the extension of said first thermal radiation shield; and second engagement stop means secured to the interior of said third radiation shield, said second engagement stop means positioned to come in contact with the third thermal contact means when said refrigerator cold end is axially inserted in said interface, limiting the compression of the flexible portion of the extension of said third thermal radiation shield.

4. The apparatus of claim 3 wherein said first and third thermal contact means comprise rings with a tapered central aperture and said second and fourth thermal contact means comprise truncated cone shaped mating portions adapted to fit in the central apertures of the first and third thermal contacts, respectively.

5. The apparatus of claim 3 further comprising first disengagement stop means secured to the interior of the outer housing, said means adapted to come in contact with said first thermal contact means when said cold end is axially withdrawn, and second disengagement stop means secured to the interior of the third radiation shield, said second disengagement stop means positioned to come in contact with the third thermal contact means when said cold end is axially withdrawn, said first and second disengagement stop means preventing excessive axial forces from being transmitted to the insert shields if contact sticking occurs.

6. The apparatus of claim 3 wherein said flexible portion of said cylindrical extensions comprise axially spaced circumferential convolutions of said cylindrical extensions.

* * * * *